US005154362A

United States Patent [19]

Knobloch et al.

[11] Patent Number: 5,154,362

[45] Date of Patent: Oct. 13, 1992

[54] APPARATUS FOR CRUSHING BRITTLE MATERIAL FOR GRINDING

[75] Inventors: Osbert R. Knobloch, Rheda-Wiedenbrück; Karl-Heinz Kuckuck, Ennigerloh, both of Fed. Rep. of Germany

[73] Assignee: Krupp Polysius AG, Fed. Rep. of Germany

[21] Appl. No.: 426,505

[22] Filed: Oct. 23, 1989

Related U.S. Application Data

[63] Continuation of Ser. No. 177,405, Apr. 4, 1988, abandoned.

[30] Foreign Application Priority Data

Apr. 10, 1987 [DE] Fed. Rep. of Germany ..... 3712147

[51] Int. Cl.[5] ..... B02C 23/12; B02C 23/38

[52] U.S. Cl. ..... 241/24; 241/20; 241/25; 241/29

[58] Field of Search ..... 241/75, 78, 15, 20, 241/24, 25, 29, 152 A, 152 R

[56] References Cited

U.S. PATENT DOCUMENTS

| | | | |
|---|---|---|---|
| 2,826,370 | 3/1958 | Weston | 241/75 X |
| 4,592,512 | 6/1986 | Grigel et al. | 241/29 X |
| 4,726,531 | 2/1988 | Strasser | 241/29 X |

*Primary Examiner*—Joseph M. Gorski
*Attorney, Agent, or Firm*—Learman & McCulloch

[57] ABSTRACT

The invention relates to a method and to apparatus for crushing brittle material for grinding, in which the material for grinding is first of all crushed in a roller mill under high pressure so that agglomerates are formed, then undergoes treatment to break up the agglomerates and afterwards is classified on a screen classifier, the oversize fraction is returned to the roller mill and the proportion of the product passing through the screen classifier is passed to a closed-circuit grinding arrangement. Such a method is distinguished by a uniform grinding operation in both crushing stages, requires low energy consumption for conveying the material for grinding from the first crushing stage to the second crushing stage and thus permits a greater spatial distance between the two crushing stages.

14 Claims, 4 Drawing Sheets

FIG. 2
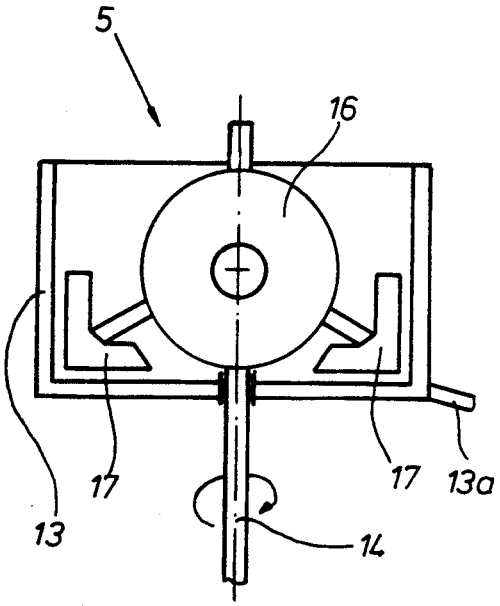
FIG. 3
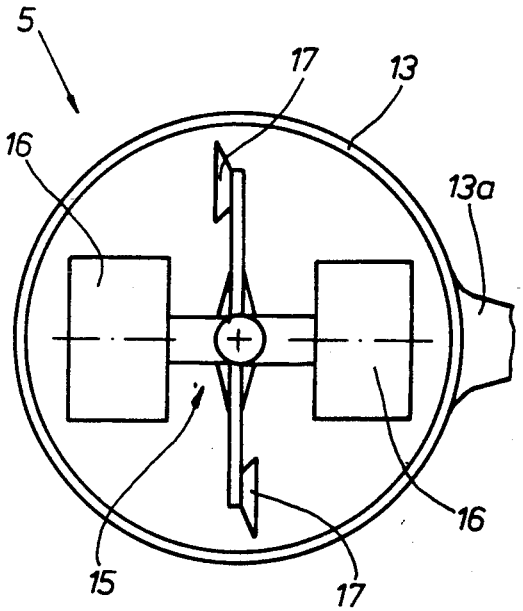
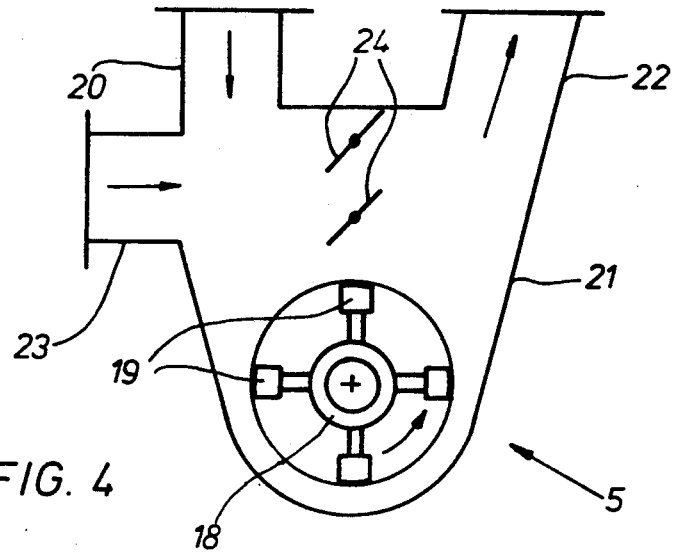
FIG. 4

APPARATUS FOR CRUSHING BRITTLE MATERIAL FOR GRINDING

This is a continuation of copending application Ser. No. 07/177,405 filed on Apr. 4, 1988 and now abandoned.

The invention relates to a crushing method and apparatus for use with brittle material in preparing such material for grinding.

BACKGROUND OF THE INVENTION

It has been the practice to treat brittle material in accordance with techniques known from FIG. 6 of EP-A-84 383. The material crushed in the roller mill is delivered directly to a screen classifier. The oversize fraction is led from the screen classifier to the tube mill (a proportion can also be returned to the roller mill). The proportion of the product passing through the screen classifier passes together with the material discharged from the tube mill to a sifter, and the fines from the sifter form the finished material, whilst the tailings are returned to the tube mill (or a proportion thereof to the roller mill).

A method of this type has certain disadvantages. Practical experiments show that the agglomerates forming the oversize fraction on the screen classifier contain a considerable proportion of fines which is not separated off in the screen classifier in view of the stability of the agglomerates. Therefore the material reaching the tube mill is poorly calibrated. Because of the high tailings recycle factor it is necessary for the roller mill to be of large dimensions.

Operational experience with roller mills which have ball mills arranged after them also shows that ball mills react comparatively sensitively to fluctuations in the coarse grain content. This applies equally for ball mills operating by the dry process and by the wet process.

A further disadvantage of this known method is that in view of the size of the agglomerates the oversize fraction precipitated in the screen classifier can only be conveyed to the tube mill pneumatically or hydraulically at very high energy costs. This disadvantage is significant above all when for reasons of plant layout the roller mill and the tube mill have to be arranged distant from one another (for example because in a plant for the manufacture of cement the roller mill has to be arranged in the proximity of the clinker cooler and thus spatially far removed from the closed-circuit grinding plant containing the tube mill or because in a mine the roller mill has to be installed at the working face but the tube mill is located in the dressing plant—equally far away from the roller mill).

SUMMARY OF THE INVENTION

The subject of the earlier application DE-A-36 09 229 is a method of crushing brittle material for grinding in which the material for grinding is first of all crushed in a roller mill and then undergoes treatment for breaking up agglomerates, after which the material is sifted and the tailings precipitated during sifting are subjected to further crushing.

The object of the invention is to develop a method and apparatus such that the overall size and the necessary drive power of the roller mill are reduced, the operating conditions in the roller mill and in the subsequent further crushing stage are improved and the total energy consumption (including the energy consumption for conveying the material for grinding) is reduced.

According to the invention the material for grinding undergoes treatment to break up agglomerates after the first crushing stage but before the screen classification. In this way the fines contained in the agglomerates are released before the subsequent screen classification. Whilst the oversize fraction screened out in the screen classifier is returned to the roller mill, the proportion of the material, which is well calibrated (for example 100% under 5 mm), passing through the screen classifier can be conveyed with low energy costs and low wear pneumatically (in the case of dry grinding) or hydraulically (in the case of wet grinding) to the subsequent closed-circuit plant (which preferably contains a tube mill and a sifter or hydrocyclone). According to the invention the roller mill can be of much smaller dimensions and requires a lower drive power.

It is also advantageous that the product which is well calibrated by the screen classifier (after first being broken up) can be stored in silos without danger of the mixture separating.

By means of the method according to the invention the operating conditions both in the roller mill and in the subsequent tube mill are substantially improved. Thus at least in the case of material for grinding which is difficult to draw in (for example clinker or ore) a marked increase and steadying of the specific throughput of the roller mill can be established. In addition, the operating conditions in the tube mill are significantly steadied by the calibration of the material for grinding achieved by means of the screen classification (after first being broken up).

Because of the possibility of energy-saving and low-wear pneumatic conveying (resulting from the good calibration of the product after crushing and screen classification) the method according to the invention is particularly suitable when the roller mill has to be arranged spatially far away from the tube mill, for example when cement mills (tube mills) which are arranged far away, for example in a separate grinding plant, have to be supplied by a roller mill arranged in the region of the kiln or the cooler.

In a similar manner the method according to the invention permits equally energy-saving and low-wear hydraulic transport in cases in which in a mine the roller mill is set up near the working face, for instance underground, but the tube mills to be supplied are arranged far away above ground in the dressing plant.

The breaking machine arranged according to the invention between the roller mill and the screen classifier can for example be a hammer mill which runs at low speed (preferably 20 to 30 m/s), the material being discharged from the hammer mill either in the air stream or by a grate base.

Another suitable form of breaking machine is an impact mill with fixed impact strips, the material being advantageously discharged through a grate base.

According to a further variant of the invention the breaking machine is formed by a disintegrator with central material delivery and peripheral material discharge.

A further advantageous variant provides as the breaking machine a Simpson mixer which contains a rotary cross assembly equipped with rollers and ploughshares, in which the rollers are kept at an adjustable minimum distance from the base of the mixer so that the product passing through the mixer is only broken up, not ground.

The aforementioned variants of breaking methods or breaking machines relate to the grinding of dry or moist material for grinding.

In the case of wet grinding and/or wet classification the breaking up of the agglomerated material for grinding takes place by the addition of fluid (preferably water) to adjust the fluid content of the slurry necessary for the transport by pumping and/or for the wet classification. In the case of brittle material for grinding the breaking up is achieved merely by adding fluid, i.e. without any further activity: experience shows that the agglomerates of brittle material then break up very easily.

In the case of material for grinding with plastic proportions which resist breaking up, in a further variant mechanical energy is supplied in a mixing vessel in such a way that during a certain period of dwell the agglomerated material for grinding is exposed to more or less sharp fluid jets (preferably water jets) or turbulence which is formed by one or more such fluid jets.

The mesh aperture of the screen classifier can advantageously be chosen with 3 to 8 mm. The screen classifier should thus separate off only the coarse-grained proportion (for example over 5 mm). This leads to a recycle factor (in the circuit formed by the roller mill, the breaking machine and the screen classifier, based on the quantity of material for grinding delivered) of 1.1 to 1.3.

THE DRAWINGS

Such a screen classifier is substantially cheaper than a sifter which is supposed to sift out the finished product and consequently cannot be so highly loaded as a screen classifier which merely separates off the coarse-grained proportion.

Some embodiments of the apparatus according to the invention are illustrated in the drawings, in which:

FIGS. 2 and 3 show a side view and a plan view of a Simpson mixer,

FIG. 4 shows a side view of a hammer mill,

DETAILED DESCRIPTION

Figure 1:
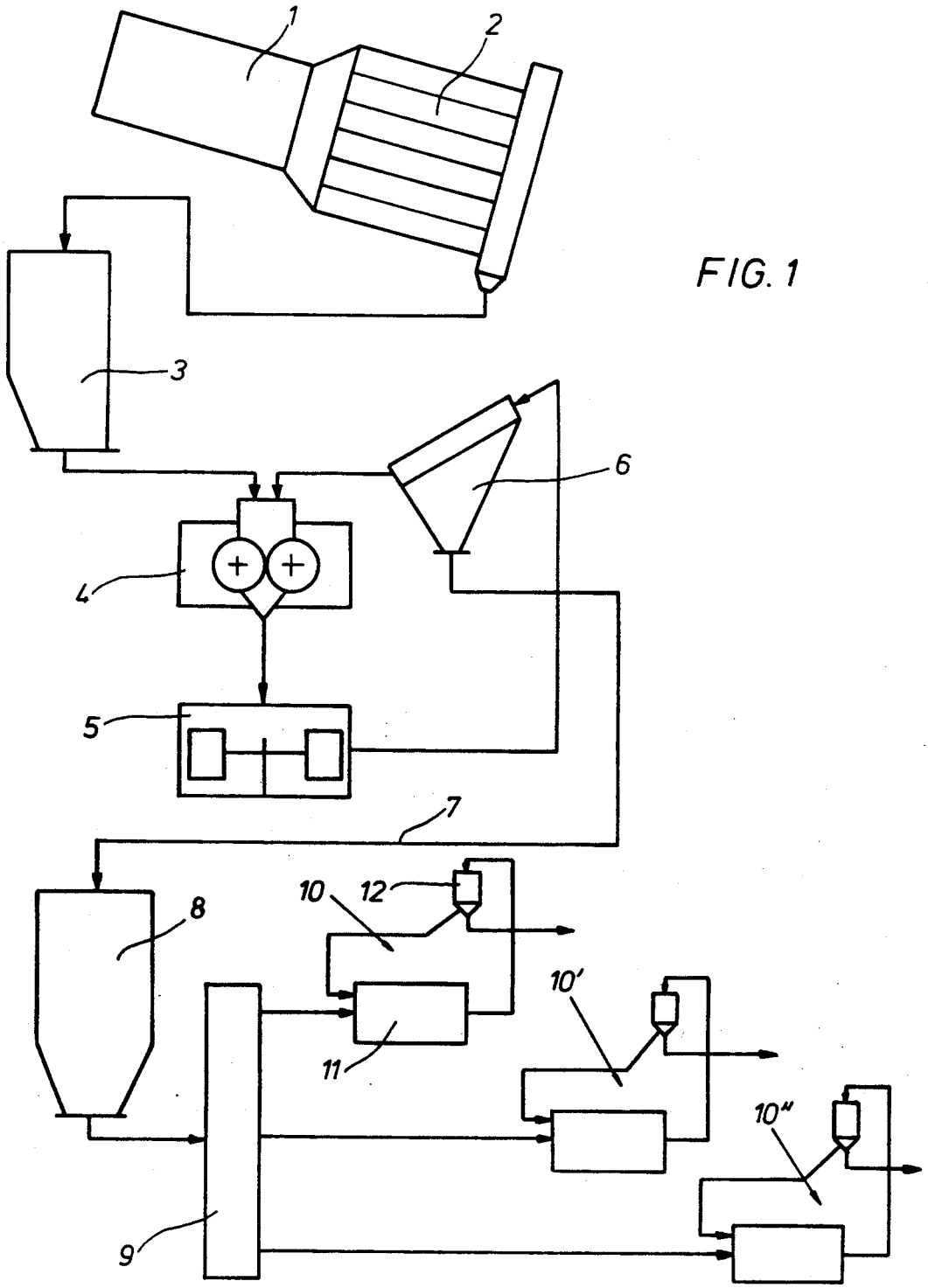
FIG. 1 shows a diagram of the whole apparatus.

The apparatus illustrated in FIG. 1 contains a rotary kiln 1 with a clinker cooler 2 constructed as a planetary coller.

The material is delivered from an intermediate bunker 3 serving as a buffer to a roller mill 4 in which the material for grinding is crushed under high pressure and agglomerates are formed.

The product discharged from the roller mill 4 enters a breaking machine 5 which is constructed for example as a Simpson mixer (FIGS. 2, 3) or a hammer mill (FIG. 4).

From the breaking machine 5 the material for grinding passes to a screen classifier 6 from which the oversize fraction is conveyed back to the roller mill 4. The proportion of material crushed in the roller mill 4 and broken up in the breaking machine 5 which passes through the screen classifier 6 is delivered to a silo 8 by a conveying track which operates for example pneumatically.

From here the pre-crushed material passes via a distributor 9 to parallel-connected closed-circuit grinding arrangements 10, 10', 10'' which each consist of a tube mill 11 and a sifter 12.

FIGS. 2 and 3 show a Simpson mixer as one embodiment of the breaking machine 5. In a fixed housing 13 with an outlet chute 13*a* it contains a rotary cross assembly 15 driven by a shaft 14 and bearing rollers 16 and ploughshares 17. The rollers 16 maintain an adjustable a minimum distance from the base of the housing 13 so that the material in the breaking machine 5 is not ground but is merely broken up, i.e. the proportion of fines is released from the agglomerates.

FIG. 4 shows the breaking machine 5 in the form of a hammer mill in which the rotor 18 has hammers 19 suspended from it. The material for grinding is introduced through a pipe 20 into the mill housing 21 and discharged pneumatically through a pipe 22. The flow speed of the air delivered via a pipe 23 is adjusted by means of valves 24.

Figure 5:
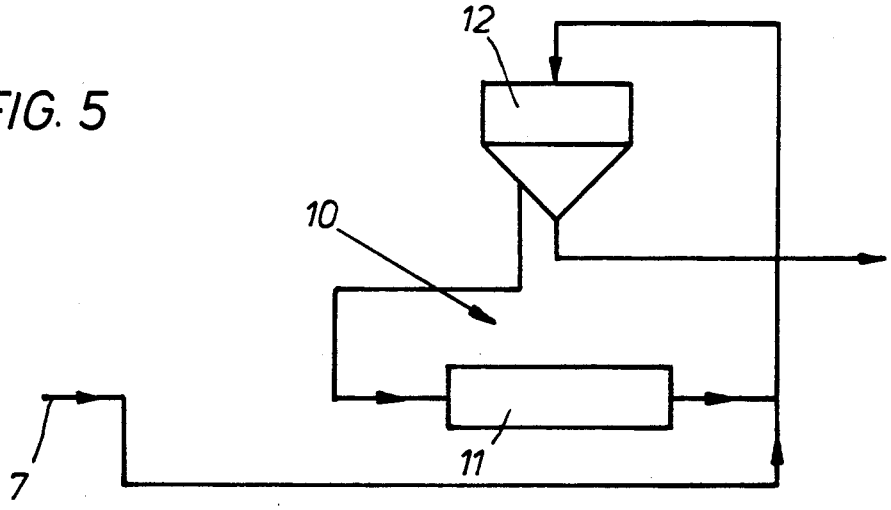
FIGS. 5 and 6 show schematic representations of further variants.

FIG. 5 shows a variant of the apparatus diagram shown in FIG. 1.

Since the proportion of the product of the first crushing stage passing through the screen classifier 6 (i.e. the material for grinding leaving the cycle formed by the roller mill 4, the breaking machine 5 and the screen classifier 6) already contains a considerable proportion of fines (for example 50% <90 μm) it is sensible to provide a circuit in the finished grinding cycle in which the said material for grinding is delivered first to the sifter 12 together with the material discharged from the tube mill 11. The oversize fraction leaving the sifter 12 is delivered to the tube mill 11. FIG. 5 shows this layout of the closed-circuit grinding arrangement 10 which is suitable for many applications.

The sifter 12 can be constructed as a two-stage sifter in which the first stage is set relatively coarse (separation limit for example 300 μm) and the fines are sifted out in a second stage in which the separation limit is for example 12 to 20 μm.

The following example may serve for further explanation of the invention:

A comparison was made between a) the method according to EP-A-84 383 in which the material crushed in the roller mill is delivered directly to a screen classifier, b) and the method according to the invention in which a breaking machine for breaking up agglomerates is provided between the roller mill and the screen classifier.

| | Variant a | Variant b |
|---|---|---|
| Throughput apparatus $\dot{M}$ (t/h) | 150 | 150 |
| Recycle ratio (roller mill) | 2.0 | 1.2 |
| Throughput roller mill $\dot{M}_W$ (t/h) | 160 | 156 |
| Specific throughput $\dot{m}_W$ (ts/hm$^3$) | 200 | 200 |
| Geometric throughput potential $\mu$ = D.L.u (m$^3$/s) | 1.3 | 0.78 |
| Necessary dimensions of the roller mill (D × L) | 1.4 × 0.66 | 1.2 × 0.45 |
| Necessary drive power of the roller mill [kW] | 600 | 468 |

The specific throughput $$\dot{m}_W = \frac{\dot{M}_W}{D \cdot L \cdot u} \left[ \frac{t \cdot s}{h \cdot m^3} \right]$$

depends upon the grain size distribution of the material delivered to the roller mill. In the case of fresh clinker it is $$120 \div 150 \frac{t \cdot s}{h \cdot m^3}.$$

in the case of a mixture of clinker and returned material it is approximately $$200 \frac{t \cdot s}{h \cdot m^3}.$$

Because of the higher tailings recycle factor a larger roller mill (with correspondingly higher drive power) is necessary in variant a than in the variant b according to the invention.

In the above table the following abbreviations are used (which have not already been explained):

roller diameter D (m)

roller gap length L (m)

peripheral speed u (m/s).

Figure 6:
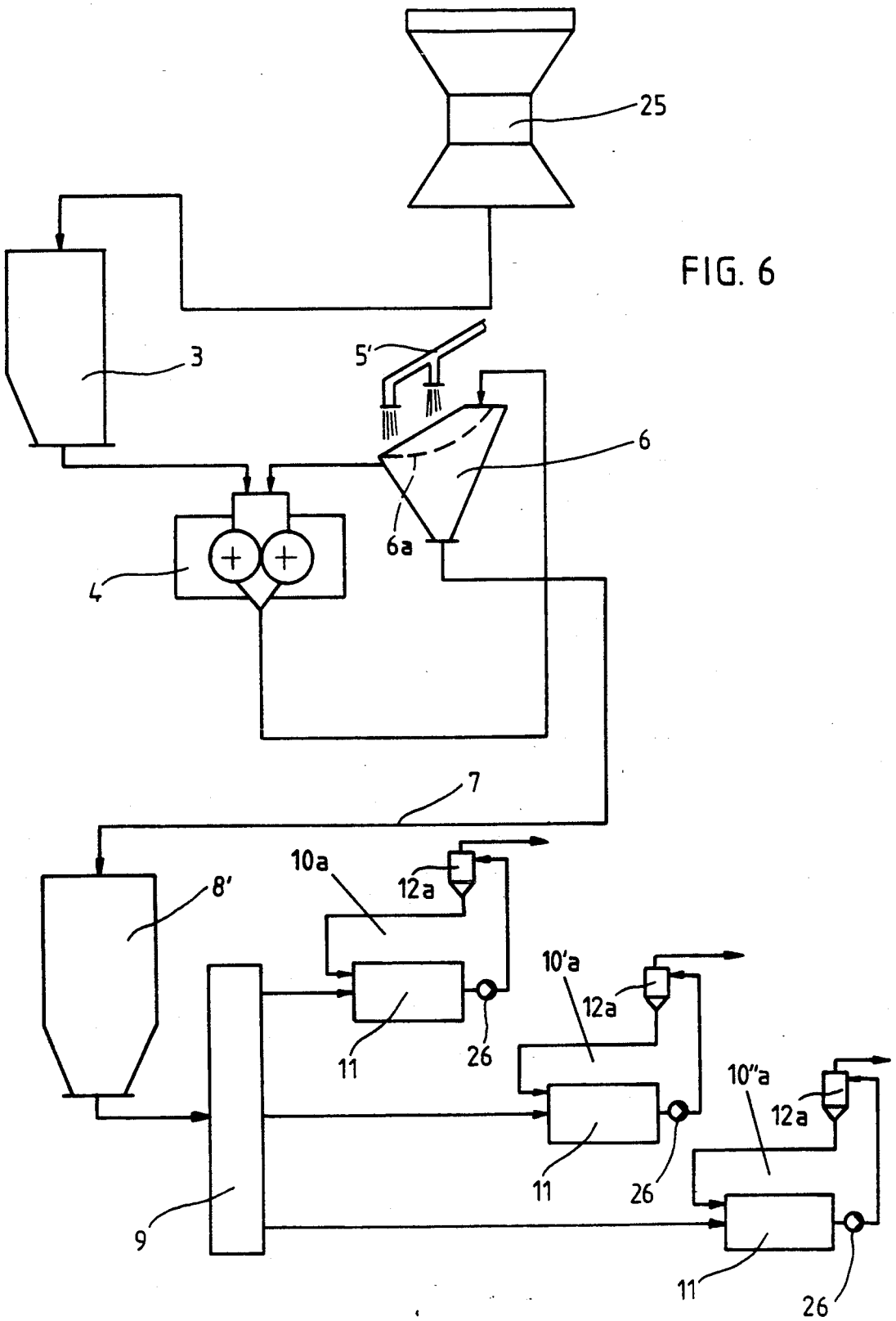

In the further embodiment of apparatus according to the invention which is illustrated in FIG. 6 the same reference numerals are used for the same components as in FIG. 1.

The apparatus contains a gyratory crusher 25 as the primary crusher, from which the pre-crushed material for grinding passes into the intermediate bunker 3 from which it is then delivered to the roller mill 4.

The product discharged from the roller mill 4 passes immediately before the screen classifier 6 to a breaking machine 5' formed by a sprayer through which fluid, preferably water, is delivered to the material for grinding falling onto a curved screen of the screen 6*a* classifier. The breaking and classification of the material for grinding are aided by the supply of fluid.

The oversize fraction is conveyed to the roller mill 4, whilst the proportion which passes through the screen classifier passes via a conveying track 7 which operates for example hydraulically to reach a storage bin 8'. From here the pre-ground and calibrated material is delivered via a distributor to the parallel-connected wet grinding arrangements 10*a*, 10'*a*, 10''*a*, which each consist of a tube mill 11, a conveyor pump 26 and a classifier 12*a* (preferably a hydrocyclone).

What is claimed is:

1. A method of treating brittle, agglomerative material comprising:

(a) supplying all of said material to be treated from a source thereof to a crushing stage;

(b) crushing all of said material at said crushing stage, thereby forming fines and agglomerates in said material;

(c) delivering all the fines and agglomerates directly from said crushing stage to a disagglomerating stage and disagglomerating the agglomerates to produce therefrom further fines;

(d) delivering all of the disagglomerated material and fines to a screening stage to separate the disagglomerated material and fines into calibrated and oversized fractions;

(e) recycling the oversized fraction to said crushing stage for further crushing thereof;

(f) delivering the calibrated fraction from said screening stage to a final grinding stage; and (g) grinding said calibrated fraction at said final grinding stage.

2. The method of claim 1 including using a fluid in said disagglomeration stage to disagglomerate said agglomerates.

3. The method of claim 1 including subjecting said agglomerates to mechanical stress in said disagglomerating stage to dissagglomerate said agglomerates.

4. The method of claim 1 including subjecting said agglomerates to fluid and mechanical stress in said disagglomerating stage.

5. The method of claim 1 wherein said fines and agglomerates are subjected to disagglomeration immediately before the screening step.

6. The method of claim 1 wherein said fines and agglomerates are subjected to disagglomeration substantially simultaneously with the screening step.

7. The method of claim 1 including storing said calibrated fraction prior to the grinding step.

8. The method of claim 1 including delivering ground material from said final grinding stage to a sifting stage, and sifting such ground material at said sifting stage to separate said ground material into further calibrated and oversized fractions.

9. The method of claim 8 including recycling the further ovesized fractions to said final grinding stage for regrinding.

10. The method of claim 9 including storing the further oversized fractions prior to the regrinding step.

11. The method of claim 1 wherein said screening stage is closer to said disagglomerating stage than to said final grinding stage.

12. The method of claim 1 wherein said crushing stage comprises a roller mill.

13. The method of claim 1 wherein said grinding stage comprises at least one tube mill.

14. The method of claim 1 wherein said grinding stage comprises a plurality of tube mills, said method including distributing the calibrated fraction among said tube mills.

* * * * *